United States Patent [19]

Christ

[11] Patent Number: 4,781,025

[45] Date of Patent: Nov. 1, 1988

[54] APPARATUS FOR THE HYDRAULIC TRANSMISSION OF MECHANICAL POWER AND FOR THE SIMULTANEOUS MULTIPLICATION OF THE SPEED OF ROTATION

[75] Inventor: Alfred Christ, Zürich, Switzerland

[73] Assignee: Sulzer-Escher Wyss AG, Zürich, Switzerland

[21] Appl. No.: 861,442

[22] Filed: May 9, 1986

[30] Foreign Application Priority Data

May 29, 1985 [CH] Switzerland ..... 02260/85

[51] Int. Cl.[4] ..... F15B 11/00

[52] U.S. Cl. ..... 60/536

[58] Field of Search ..... 60/536; 91/485; 417/539, 426, 429

[56] References Cited

U.S. PATENT DOCUMENTS

| | | | |
|---|---|---|---|
| 386,116 | 7/1888 | DuBois | 60/536 |
| 862,867 | 8/1907 | Eggleston | 417/390 |
| 1,931,952 | 10/1933 | Charles | 60/536 |
| 2,198,965 | 4/1940 | Habig et al. | 60/536 |
| 2,297,610 | 9/1942 | DeGiers | 60/536 |
| 2,597,050 | 5/1952 | Audemar | 60/536 |
| 3,816,029 | 6/1974 | Bowen et al. | 417/539 X |
| 3,959,703 | 5/1976 | Rosen | 417/415 X |

*Primary Examiner*—Edward K. Look
*Attorney, Agent, or Firm*—Werner W. Kleeman

[57] ABSTRACT

The apparatus has at least one cam plate driven by a drive shaft in a piston pump or hydraulic pressure generator. The cam plate has a cam track or surface with at least two substantially sinusoidal protrusions and recesses or depressions on its circumference or perimeter. The rotation of this cam plate drives a crankshaft of a hydraulic piston and cylinder drive unit or motor by means of at least one plunger or cam follower or tappet and a piston through at least one transmission pipeline or conduit filled with a hydraulic medium. This transmission pipeline is attached without valves to the cylinder of the piston and is connected by means of an also valveless cylinder with a piston of the hydraulic piston and cylinder drive unit or motor. The cam track or surface is so structured that during uniform rotation of the cam plate of the piston pump or hydraulic pressure generator and the crankshaft of the hydraulic piston and cylinder drive unit or motor, the volume of that part of the system filled with the hydraulic medium, i.e. the total volume including the pump piston displacement, cylinder dead space and the volume of the transmission pipeline or conduit, plus the volume of the motor piston displacement, remains constant over time.

19 Claims, 2 Drawing Sheets

APPARATUS FOR THE HYDRAULIC TRANSMISSION OF MECHANICAL POWER AND FOR THE SIMULTANEOUS MULTIPLICATION OF THE SPEED OF ROTATION

BACKGROUND OF THE INVENTION

The present invention broadly relates to an apparatus for the hydraulic transmission of mechanical power and for the simultaneous multiplication or step-up of the speed of rotation.

Generally speaking, the apparatus of the present invention is capable of transmitting power from a comparatively slow-running drive means to a comparatively fast-running power load or driven means, wherein the drive means and the power load or driven means can be separated so remotely from one another such that even though a conventional belt drive or transmission or gear transmission or gearbox is impractical other suitable power transmitting means can be reliably interposed between the drive means and the driven means.

A typical examplary application for such a power transmission is to transmit the power of a low pressure water turbine, which is installed at as low a level as possible, to a generator, which is preferably constructed at the floor level of related machinery. As a result of the small pressure head of the turbine, the turbine must rotate slowly, wherein a typical speed of rotation is approximately 100 rpm. On the other hand, the generator should run relatively fast, e.g. between 1,000 and 1,500 rpm, since more efficient electrical designs are possible with this type of generator than with slower-running four-pole generators.

A rotary speed step-up or multiplication ratio of 1:10 or 1:15 is thus desirable. Even if spatial conditions would permit a conventional arrangment such as a belt or gear drive, such a large step-up ratio would cause difficulties with power transmission by gearboxes or belt drives, especially due. to the disproportionately small size of the pinion or the smaller belt pulley in relation the larger gear or pulley.

The above discussion indicates the need for a power transmission apparatus of a new type of construction which has a high speed step-up or multiplication ratio.

For all types of power transmission, hydraulic direct-flow transmission means are known which employ oil or hydraulic fluid pumps, pressure transmission pipelines or conduit means, oil or hydraulic motors, and return pipelines or conduit means, supplemented by auxiliary systems for filling, cooling and filtering.

For transmitting high power at high levels or rates, for example in the megawatt range, relatively high pressures must generally be employed which results in the problem well known to the person skilled in the art, of considerable noise from pumps and motors and, likewise, the problem of the degree of efficiency of power transmission, which at best falls in the range of up to 80%. This is obviously considerably less than 90% or above, such as would be achievable with power transmission by gearboxes or belt transmission drive means.

SUMMARY OF THE INVENTION

Therefore, with the foregoing in mind, it is a primary object of the present invention to provide a new and improved construction of an apparatus for the hydraulic transmission of mechanical power and for the simultaneous multiplication or step-up of the speed of rotation of a desired member and which apparatus does not exhibit the aforementioned drawbacks and shortcomings of the prior art constructions.

A further significant object of the present invention aims at providing a new and improved construction of an apparatus of the character described for the hydraulic transmission of mechanical power and for the simultaneous multiplication or step-up of the speed of rotation and which apparatus is relatively simple in construction and design, economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention, among other things, is manifested by the features that cam plate of a piston pump or hydraulic pressure generator driven by a drive shaft has a cam track or surface with at least two substantially sinusoidal protrusions and recesses or depressions on its circumference or periphery. The piston pump or hydraulic pressure generator drives a crankshaft or drive through at least one plunger or cam follower and piston and at least one transmission pipeline or conduit. The transmission pipeline or conduit is attached without valves to the cylinder of such piston. The transmission pipeline is filled with a hydraulic medium. The transmission pipeline is attached to likewise valveless cylinders accommodating pistons of a hydraulic piston and cylinder drive unit or motor. The cam track or surface is structured such that during essentially uniform rotation of both the cam plate of the pump and the crankshaft of the motor, the volume of the system filled with hydraulic medium, i.e. the volume of the pump piston displacement plus cylinder dead space plus the volume of the transmission pipeline or conduit plus the volume of the motor piston displacement remains essentially constant over time.

In order to accommodate possible piston-seal leakage effects and compressibility effects which could adversely affect or impair the essentially constant volume over time, a supply or fluid replenishment or make-up apparatus is proposed which is useful and advantageous. This fluid replenishment apparatus is provided with a chamber of selectable pressure which is connected by means of throttling or flow-restricting elements to all transmission pipelines or conduits.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
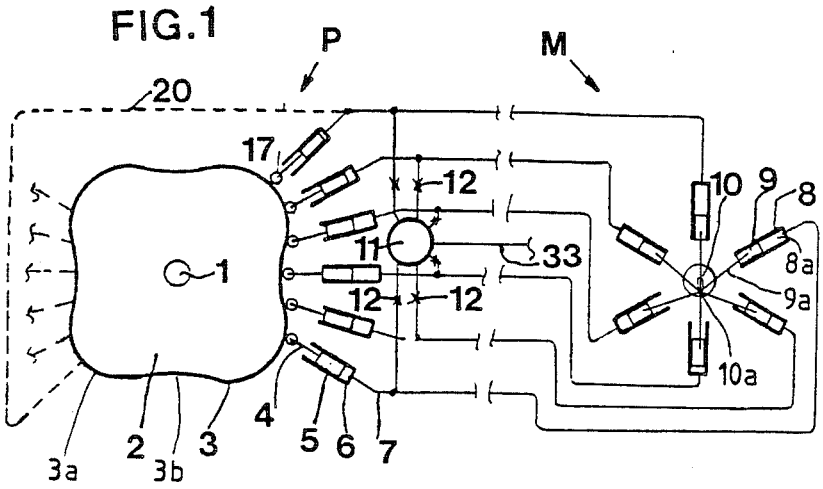
FIG. 1 schematically illustrates a first preferred embodiment of the apparatus according to the invention.

Describing now the drawings, it is to be understood that to simplify the showing thereof, only enough of the structure of the apparatus for the hydraulic transmission of mechanical power and for the simultaneous multiplication or step-up of the speed of rotation has been illustrated therein as is needed to enable one skilled in the art to readily understand the underlying principles and concepts of the present invention. Turning now specifically to FIG. 1 of the drawings, the apparatus illustrated therein by way of example and not limitation will be seen to comprise an apparatus that is capable of power transmission with simultaneous multiplication or step-up of the speed of rotation and which operates according to the principle of hydraulic alternating-flow power transmission. For this purpose, power is transmitted from a hydraulic pressure generator or piston pump P serving as drive means to a hydraulic piston and cylinder drive unit or motor M serving as a power load or driven means. A cam plate 2 having in general, n substantially sinusoidal protrusions 3*a* and recesses. or depressions 3*b* relative to a circular base circle on the circumference of a therewith associated cam track or surface 3 is mounted on a drive shaft 1 of the piston pump P. As illustrated in FIG. 1, n equals 4. The cam track or surface 3 actuates pistons 5 reciprocating in cylinders 6 by means of rollers 17 and plungers or cam followers 4 in a likewise substantially sinusoidal cycle or tact.

Extending from the cylinders 6 to the hydraulic piston and cylinder drive unit or motor M are transmission conduits or pipelines 7, of which six units are illustrated in FIG. 1. The transmission conduits or pipelines 7 are filled with a suitable hydraulic fluid, such as oil. Each of the transmission conduits or pipelines 7 is connected without valves to an associated cylinder 8. The cylinders 8 are preferably radially positioned about a crankshaft or crank drive 10 comprising crank throw and crank journal means generally indicated by reference character 10*a*. All pistons 9 of the hydraulic piston and cylinder drive unit or motor M act through connecting rods 9*a* upon this crankshaft 10. The crankshaft or crank drive 10 defines an eccentric drive means of a drive mechanism for the hydraulic piston and cylinder drive unit or motor M.

It is this crankshaft 10 which, by virtue of its crank to connecting rod relationship, in conjunction with the roller diameter or roller size relationship, determines the exact contour of the cam track or surface 3 which is mounted on the drive shaft 1. The cam track contour is determined such that under essentially uniform rotation of the piston pump P and of the piston and cylinder drive unit or motor M, the enclosed fluid volumes remain substantially constant over time in each sub-system of cylinders 6 and 8 and associated transmission pipeline or conduit 7 which are filled with hydraulic fluid. That is, the sum of the pump piston displacement volume, the transmission pipeline or conduit volume, the motor piston displacement volume and the cylinder dead space remains essentially constant.

During the transmission of high levels or rates of power, it is obvious that significantly high pressures occur in the pipelines or conduits 7 which are filled with hydraulic medium. This leads, as a result of the slight but nevertheless real compressibility, to a time-temporal variation in volume: the volume increases or decreases, respectively, in inverse relation to the cycle of pressure. In operation, the hydraulic medium is subject to possible variations in pressure having a temporal mean value.

Also, possible hydraulic medium leaks between the pistons 5 and 9 and their respective cylinders 6 and 8 slowly lead to a deficiency of hydraulic fluid. Therefore, the risk also exists that, e.g. the rollers 17 may raise or lift from the cam track 3, i.e. float, causing the apparatus to run very roughly or to break tact.

In order to prevent this from occurring, a supply or fluid replenishment or make-up apparatus is provided which can supply or remove minute slight quantities of hydraulic fluid from a chamber 11 of selectable pressure through a respective throttling or flow-restricting element or unit 12 that is connected to a suitable point of the related transmission pipeline or conduit 7. In other words, each of the individual cylinder 6 - conduit 7 - cylinder 8 closed hydraulic sub-systems is connected by means of an individual throttling or flow-restricting element or unit 12 to this chamber 11 of selectable pressure.

With the aid of this fluid suppy or fluid replenishment apparatus, it is possible to achieve smooth running and noiseless operation, to prevent the plunger 4 from raising or lifting from the cam plate 2 i.e., the cam track or surface 3, i.e. to prevent floating thereof, and to guarantee that the transmission be self-synchronizing at start-up or run-up. Simultaneously, significantly lower requirements of manufacturing precision are imposed on the form of the cam plate 2, i.e. on the cam track or surface 3.

The pressure selected in the chamber 11 depends on the level or rate of power to be transmitted and possibly also on the speed of revolution and degree of speed multiplication. It is appropriately adjusted so that it lies in the region of 70–130% of the average pressure value over time or temporal means value in any given transmission pipeline or conduit 7. This pressure may be provided, for instance, by means of a conventional auxiliary pump and an adjustable pressure relief valve, both of which are not particularly shown or further described, through a supply line conduit 33 which leads into the chamber 11.

Figure 2:
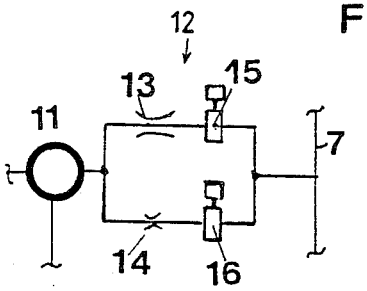
FIG. 2 schematically illustrates a throttling or flow-restricting element or unit.

The throttling or flow restricting elements or units 12 which are inserted between the chamber 11 and the transmission pipelines or conduits 7 can be constructed, as is shown in detail in FIG. 2, as multiple throttles or flow-restricting elements connected in parallel, for example with two throttling or flow-restricting locations or throttles 14 and 13 connected in parallel and having either equally large or different flow cross sections. The flow paths can be selectively opened or blocked by valves 15 and 16.

Figure 3:
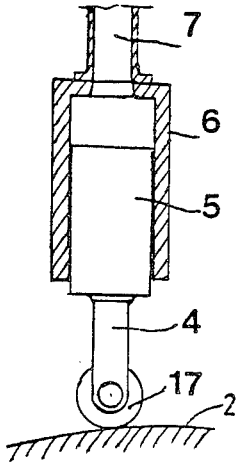
FIGS. 3 to 6 illustrate cross-sectional views of four different preferred embodiments of the cylinder with the piston and the plunger or cam follower of the piston pump or hydraulic pressure generator.
Figure 4:
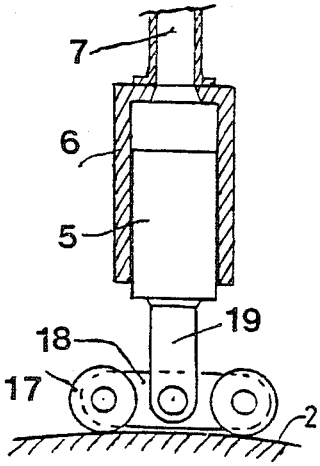

As can be clearly seen in FIG. 3, the plungers or cam followers 4 which actuate the pistons 5 positioned around the cam plate 2 are preferably structured as roller plungers or cam followers with rollers 17 in order to avoid or reduce frictional or sliding wear or abrasion. If even relatively great forces are to be accommodated, multiple rollers 17 can be utilized for the actuation of related plungers or cam followers 19, which then are grouped together in a pivotable mounting structure or equalizing carriage 18 and in this way cooperate with the piston 5 as is shown in detail in FIG. 4.

Figure 6:
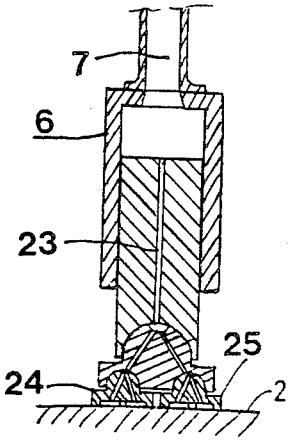
Figure 5:
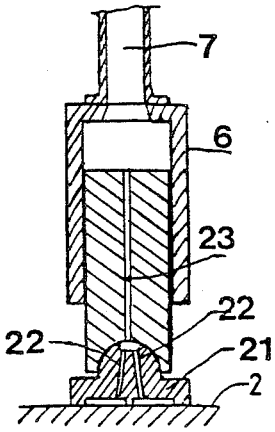

As an alternative to plungers or cam followers 4 provided with the rollers 17, hydrodynamic sliding contact plungers or tappets can also be utilized, or more preferably hydrostatic pressure support plungers or tappets utilizing the known principle of hydrostatic support and lubrication. As can be seen from FIG. 5, the pressure lubrication fluid for a hydrostatic plunger or cam follower 21 is advantageously extracted from the cylinder space or volume of the associated cylinder 6 or from the associated transmission pipeline or conduit 7 through throttling or flow-retarding bores 23 and 22. The supply or fluid replenishment apparatus must then be designed corresponding to this fluid consumption. The radius of curvature variation of the cam track or surface 3 must of course be taken into account when designing such hydrostatic supported plungers or cam followers 21. If necessary, the surface area of the plungers or cam followers 21 which is in hydrostatic contact with the cam track or surface 3 can be divided into narrow, mutually relatively movable, transversely-oriented individual surface areas 24 and 25, as can be seen in detail in FIG. 6.

The arrangement of the plunger or cam follower 4 on the circumference of the cam plate 2 depends of course on the construction of the hydraulic piston and cylinder drive unit or motor M. If, for example, the crankshaft 10 is provided with six radial cylinders 8 and with a chosen speed multiplication or step-up ratio of, for example 1:4, between a first or input speed and a second or output speed, then each of the six plungers or cam followers 4 will be arranged with a uniform mutual angular spacing of 15° within one quadrant of the eccentric member or cam plate 2.

In order to protect the cam plate 2 from unilaterally acting forces of the plunger or cam follower 4, additional cam followers 4 with their pistons 5 and cylinders 6 can be arranged substantially directly opposite to each first cam follower 4 on the cam plate 2. Their positions are indicated with dashed lines in the left-hand portion of FIG. 1. The two opposing cylinders then always cooperate on one transmission pipeline or conduit 7. A connecting pipeline or conduit 20 leads from each of the opposing cylinders to the respective transmission pipeline or conduit 7. Such a connecting pipeline or conduit 20 is indicated with a dashed line in FIG. 1.

Generally, even more cylinders 6 can be positioned on the circumference of the cam plate 2, wherein all cylinders operating in the same phase on the circumference are connected in parallel. Even though in such an arrangement more cylinders 6 are of course necessary, nonetheless, the plungers or cam followers 4 are subject to smaller forces and thus can be more simply constructed.

The power load or driven means, i.e. the hydraulic piston and cylinder drive unit or motor M can, as already mentioned, utilize the crankshaft 10, either with opposed or radially arranged cylinders 8 which all act with their pistons 9 on a single crank of the crankshaft 10, or the cylinders 8 can also be arranged in line and can act on an appropriate multiple-throw crankshaft.

Figure 7:
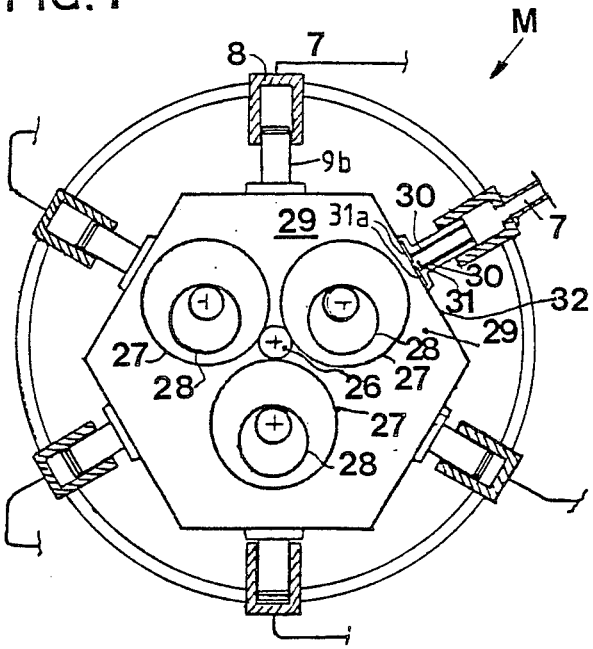
FIG. 7 schematically illustrates another preferred embodiment of an appropriate hydraulic piston and cylinder drive unit or motor.

If higher speed multiplication or step-up ratios are necessary or required, the hydraulic piston and cylinder unit or motor M can be combined in a compact manner with a gearbox or transmission drive unit, or the crankshaft 10 can be replaced by a prismatic member 29 which is displaceable in an eccentric path and which is subjected to forces from the pistons 9 via hydrostatically supported followers or shoes. Such a hydraulic piston and cylinder drive unit or motor M is schematically illustrated in FIG. 7. In order to further increase the compactness of the entire motor block, hydrostatic power transmission elements or pressure shoes 31 are preferably utilized between the piston or plunger **9*b* and the prismatic member 29 which conduct the hydraulic pressure fluid in known manner from the cylinder volume beyond the throttling or flow-restricting channels 30 into the pressure pockets or recesses 31*a* of the piston or plunger 9*b*. For constant or continuous alignment of the pressure shoe 31, at least three hydrostatic or pressure pockets or recesses 31*a* are necessary, however, four are preferred in practice. It is also possible in this case to feed in the pressure fluid required by the hydrostatic elements or pressure shoes 31** by means of the supply or fluid replenishment apparatus. Simultaneously, a reduced hydraulic fluid flow or circulation is thus achieved, avoiding excessive heating of the hydraulic fluid caused by continuous frictional losses, however small.

As illustrated in FIG. 7, such a hydraulic piston and cylinder drive unit or motor M comprises at least one radially arranged cylinder 8 whose piston **9*b* acts as a plunger or follower in a power-conveying and positively engaging manner on the prismatic member 29 which moves in an eccentric path. The eccentric movement of the prismatic member 29 is transmitted by means of a multiplication or step-up transmission to a gear or pinion 26 which absorbs the transmitted power. The prismatic member 29 defines an orbital body and cooperates with the eccentric members or cams 28 to form an eccentric drive means of a drive mechanism for the hydraulic piston-and-cylinder drive unit or motor M. At least two gears 27 or similar devices mesh with the pinion 26 and are actuated by the prismatic member 29. These gears 27 revolve along an eccentric path on eccentric members or cams 28. The forces and motion imparted by the transmission pipelines or conduits 7 are transmitted through the hydrostatic pressure shoes 31 by means of the pistons 9*b* which are supplied with hydraulic pressure through the throttling or flow-restricting channels 30 of the hydraulic piston and cylinder drive unit or motor M onto prismatic surfaces or faces 32 of the prismatic member 29. The ability or capacity to multiply or step-up the speed of rotation of the described hydraulic piston and cylinder drive unit or motor M is given by the diameter relationship between the gears 27 and the pinion 26**.

While there are shown and described present preferred embodiments of the invention, it is to be distinctly understood that the invention is not limited thereto, but may be otherwise variously embodied and practiced within the scope of the following claims.

Accordingly what I claim is:

1. An apparatus for hydraulically transmitting mechanical power and simultaneously multiplying rotary speed, comprising:

a hydraulic motor;

a hydraulic pump operatively connected to said hydraulic motor;

said hydraulic pump comprising a cam plate defining a cam profile, a power-input drive shaft for driving said cam plate and a predetermined number of plunger-and-cylinder units;

said cam profile comprising at least two cycles of substantially cyclical deviation from a base circle for multiplying the rotational speed between the hydraulic pump and the hydraulic motor in direct relationship to the number of said at least two cycles;

said predetermined number of plunger-and-cylinder units being substantially radially oriented relative to said power-input drive shaft for following said cam profile;

said hydraulic motor comprising a power-output drive shaft, a drive mechanism for driving said power-output drive shaft and a predetermined number of piston-and-cylinder units;

each plunger-and-cylinder unit comprising a plunger;

each piston-and-cylinder unit comprising a piston;

conduit means connecting each said plunger-and-cylinder unit to an associated piston-and-cylinder unit of said piston-and-cylinder units such that a mechanical motion imparted by said cam profile to said plunger is transmitted by a hydraulic medium to said associated piston-and-cylinder unit for imparting mechanical motion to said piston;

said pistons engaging said drive mechanism such that said mechanical motion conjointly imparts to said drive mechanism an eccentric motion;

said drive mechanism comprising eccentric drive means for converting said eccentric motion of said drive mechanism to a rotary motion of said power-output drive shaft;

each said plunger-and-cylinder unit and said therewith associated piston-and-cylinder unit defining conjointly with said conduit means connecting said plunger-and-cylinder unit to said associated piston-and-cylinder unit a respective hydraulic volume.

2. The apparatus as defined in claim 1, wherein:

said drive mechanism comprises connecting rods and eccentric journal means; and said eccentric drive means comprising crank throw means.

3. The apparatus as defined in claim 2, wherein:

each piston-and-cylinder unit of said piston-and-cylinder units of said hydraulic motor comprises a cylinder;

said cylinders being arranged as a radial motor; and said connecting rods connecting said pistons through said journal means with said crank throw means to form a radial motor crankshaft drive.

4. The apparatus as defined in claim 1, wherein:

said drive mechanism comprises an orbital body; and said eccentric drive means comprising eccentric gear transmission means.

5. The apparatus as defined in claim 1, wherein:

said substantially cyclical deviation comprises a substantially sinusoidal deviation.

6. The apparatus as defined in claim 1, further including:

a chamber for containing said hydraulic medium at a selectable pressure; and throttling means operatively connecting said chamber to each of said conduit means.

7. The apparatus as defined in claim 6, wherein:

said throttling means comprises at least two throttling passages connected in parallel;

each said throttling passage of said at least two throttling passages defining an associated flow cross-section; and valve means for selectively obturating and opening each of said associated flow cross-sections.

8. The apparatus as defined in claim 7, wherein:

said at least two throttling passages each define equal associated flow cross-sections.

9. The apparatus as defined in claim 7, wherein:

said at least two flow passages each define different associated flow cross-sections.

10. The apparatus as defined in claim 1, wherein:

each said plunger comprises at least one roller cam follower for contacting said cam profile.

11. The apparatus as defined in claim 10, wherein:

each said plunger comprises at least one cam follower equalizing carriage carrying a plurality of said roller cam followers.

12. The apparatus as defined in claim 1, wherein:

said at least two cycles of substantially cyclical deviation of said cam profile from the base circle each define a different operative region of said cam plate;

said hydraulic pump being associated with a first operative region of said different operative regions;

at least one further hydraulic pump associated with at least one respective further operating region of said different operating regions;

said hydraulic pump being associated with said first operating region and said at least one further hydraulic pump being associated with said at least one respective further operating region such that said predetermined number of plunger-and-cylinder units enjoy predetermined phase relationships; and said conduit means connecting in parallel plunger-and-cylinder units enjoying the same phase relationship.

13. The apparatus as defined in claim 1, wherein:

each said plunger comprises a hydrostatic pressure shoe for contacting said cam profile; and each said plunger comprising at least one throttling passage connecting said hydrostatic pressure shoe with said hydraulic medium.

14. The apparatus as defined in claim 13, wherein:

each said hydrostatic pressure shoe is sub-divided such that its weight effective in the direction of the cam profile is reduced.

15. The apparatus as defined in claim 14, wherein:

each said hydrostatic pressure shoe being sub-divided into two oppositely moveable individual hydrostatic pressure shoes.

16. The apparatus as defined in claim 1, wherein:

each piston-and-cylinder unit of said piston-and-cylinder units of said hydraulic motor comprises a cylinder;

said cylinders being arranged as a radial motor;

said drive mechanism comprising a prismatic body for performing an orbital motion;

each said piston comprising plunger means for displacing said prismatic body in said orbital motion;

said power-output drive shaft comprising a pinion gear;

said prismatic body comprising at least one eccentric means for supporting gear transmission means engaging said pinion gear for transmitting mechanical power from said prismatic body to said pinion gear;

said gear transmission means comprising at least one gear meshing with said pinion gear and eccentrically journaled for rotation on said at least one eccentric means;

each said plunger means comprising hydrostatic pressure shoe means and at least one throttling passage connecting said hydrostatic pressure shoe means with said hydraulic medium; and said plunger means transmitting forces induced by said hydraulic medium in said piston-and-cylinder units to said prismatic body.

17. The apparatus as defined in claim 1, wherein:

said predetermined number of plunger-and-cylinder units comprises at least two plunger-and-cylinder units.

18. The apparatus as defined in claim 1, wherein:

said predetermined number of plunger-and-cylinder units comprises at least two plunger-and-cylinder units.

19. An apparatus for hydraulically transmitting mechanical power and simultaneously multiplyiing rotary speed, comprising:

a hydraulic motor;

a hydraulic pump operatively connected to said hydraulic motor;

said hydraulic pump comprising a cam plate defining a cam profile, a power-input drive shaft for driving said cam plate and a predetermined number of plunger-and-cylinder units;

said cam profile comprising at least two cycles of substantially cyclical deviation from a base circle for multiplying the rotational speed between the hydraulic pump and the hydraulic motor in direct relationship to the number of said at least two cycles;

said predetermined number of plunger-and-cylinder units being substantially radially oriented relative to said power-input drive shaft for following said cam profile;

said hydraulic motor comprising a power-output drive shaft, a drive mechanism for driving said power-output drive shaft and a predetermined number of piston-and-cylinder units;

each plunger-and-cylinder unit comprising a plunger;

each piston-and-cylinder unit comprising a piston;

conduit means connecting each said plunger-and-cylinder unit to an associated piston-and-cylinder unit of said piston-and-cylinder units such that a mechanical motion imparted by said cam profile to said plunger is transmitted by a hydraulic medium to said associated piston-and-cylinder unit for imparting mechanical motion to said piston;

said pistons engaging said drive mechanism such that said mechanical motion conjointly imparts to said drive mechanism an eccentric motion;

said drive mechanism comprising eccentric drive means for converting said eccentric motion of said drive mechanism to a rotary motion of said power-output drive shaft;

each said plunger-and-cylinder unit and said therewith associated piston-and-cylinder unit defining conjointly with said conduit means connecting said plunger-and-cylinder unit to said associated piston-and-cylinder unit a respective essentially constant hydraulic volume; and said cam profile having a configuration defining said substantially cyclical deviation from the base circle such that said power-input drive shaft rotates at a first mssentially uniform speed and said power-output drive shaft rotates at a second essentially uniform speed.

* * * * *

UNITED STATES PATENT AND TRADEMARK OFFICE

CERTIFICATE OF CORRECTION

PATENT NO. : 4,781,025

DATED : November 1, 1988

INVENTOR(S) : ALFRED CHRIST

It is certified that error appears in the above-identified patent and that said Letters Patent is hereby corrected as shown below:

Column 1, line 22, please delete "examplary" and insert --exemplary--

Column 1, line 36, please delete "arrangment" and insert --arrangement--

Column 2, line 18, after "that" please insert --a--

Column 4, line 26, please delete "suppy" and insert --supply--

Column 7, line 26, after "shaft;" please insert --and--

Column 9, line 14, please delete "multiplyiing" and insert --multiplying--

Column 10, line 30, please delete "mssentially" and insert --essentially--

Signed and Sealed this

Twenty-fifth Day of July, 1989

*Attest:*

*Attesting Officer*

DONALD J. QUIGG

*Commissioner of Patents and Trademarks*